US010508540B2

(12) United States Patent
Siepenkort et al.

(10) Patent No.: US 10,508,540 B2
(45) Date of Patent: Dec. 17, 2019

(54) PLOW GUIDE ASSEMBLY FOR PLOW GUIDES

(71) Applicant: Caterpillar Global Mining Europe GMBH, Lünen (DE)

(72) Inventors: Gerhard Siepenkort, Lünen (DE); Klaus Duhnke, Werne (DE); Susanne Wutzke, Holzwickede (DE); Frank Reitenbach, Lünen (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 93 days.

(21) Appl. No.: 15/513,872

(22) PCT Filed: Apr. 1, 2015

(86) PCT No.: PCT/EP2015/000707
§ 371 (c)(1),
(2) Date: Mar. 23, 2017

(87) PCT Pub. No.: WO2016/045757
PCT Pub. Date: Mar. 31, 2016

(65) Prior Publication Data

US 2017/0292378 A1 Oct. 12, 2017

(30) Foreign Application Priority Data

Sep. 25, 2014 (EP) ..... 14186374

(51) Int. Cl.
*E21C 35/12* (2006.01)
*E21C 29/14* (2006.01)
(Continued)

(52) U.S. Cl.
CPC ..... *E21C 35/12* (2013.01); *E21C 27/32* (2013.01); *E21C 27/34* (2013.01); *E21C 29/14* (2013.01); *E21F 13/066* (2013.01)

(58) Field of Classification Search
CPC ..... E21C 27/32; E21C 27/34; E21C 27/35; E21C 29/14; E21C 35/12
See application file for complete search history.

(56) References Cited

U.S. PATENT DOCUMENTS 4,067,619 A * 1/1978 Peters ..... E21C 27/34 299/43
4,108,495 A * 8/1978 Hauschopp ..... E21C 27/32 299/43
(Continued)

FOREIGN PATENT DOCUMENTS

CN 1948710 4/2007
CN 102016229 4/2011
(Continued)

OTHER PUBLICATIONS

International Search Report related to Application No. PCT/EP2015/000707 reported on Nov. 20, 20150.
(Continued)

*Primary Examiner* — David J Bagnell
*Assistant Examiner* — Michael A Goodwin
(74) *Attorney, Agent, or Firm* — Pavan K Potharaju

(57) ABSTRACT

The present disclosure relates to a plow guide assembly for guiding a mining plow. The plow guide assembly may comprise a base member including a first guide beam for guideing the mining plow and extending along a first axis, and a second guide beam spaced apart the first guide beam for defining a service clearance therebetween, and extending along a second axis axially aligned to the first axis. The plow guide assembly may further comprise an insert element insertable into the service clearance and having a third guide beam extending along a third axis. In an assembled state of the insert element, the third axis is axially aligned to the first and second axes.

15 Claims, 8 Drawing Sheets

(51) Int. Cl.

| | |
|---|---|
| ***E21C 27/34*** | (2006.01) |
| ***E21C 27/32*** | (2006.01) |
| ***E21F 13/06*** | (2006.01) |

(56) References Cited

U.S. PATENT DOCUMENTS

| | | | | |
|---|---|---|---|---|
| 4,391,471 | A * | 7/1983 | Hauschopp | E21C 35/12 198/735.1 |
| 4,607,890 | A * | 8/1986 | Merten | E21C 35/12 198/735.1 |
| 5,139,313 | A * | 8/1992 | Fiesel | E21C 35/12 299/34.1 |
| 7,399,039 | B2 * | 7/2008 | Bettermann | E21C 35/12 299/34.1 |
| 2005/0161995 | A1 * | 7/2005 | Tillessen | E21C 35/12 299/34.1 |
| 2007/0205007 | A1 | 9/2007 | Bettermann et al. | |
| 2010/0288604 | A1 * | 11/2010 | Klabisch | E21C 35/12 198/735.1 |
| 2010/0320828 | A1 * | 12/2010 | Klabisch | E21C 29/14 299/47 |

FOREIGN PATENT DOCUMENTS

| | | | | |
|---|---|---|---|---|
| DE | 1277181 | B * | 9/1968 | E21C 35/12 |
| DE | 2509921 | A1 | 9/1976 | |
| DE | 20 2004 004652 | U1 | 5/2004 | |
| GB | 2073286 | A | 10/1981 | |
| GB | 2130624 | A | 6/1984 | |

OTHER PUBLICATIONS

European Search Report related to Application No. 14186374 reported on Mar. 6, 2015.

* cited by examiner

PLOW GUIDE ASSEMBLY FOR PLOW GUIDES

CROSS-REFERENCE TO RELATED APPLICATION

This Application is a 35 USC § 371 U.S. National Stage filing of International Application No. PCT/EP2015/000707 filed on Apr. 1, 2015 which claims priority under the Paris Convention to European Serial No. 14186374.6 filed on Sep. 25, 2014.

TECHNICAL FIELD

The present disclosure generally relates to a plow guide assembly for plow guides of chain-drawn mining plows movably connected to a chain scraper conveyor used in underground mining applications.

BACKGROUND

Known plow guide troughs or plow guide elements are used especially in underground mining, in the case of, for instance, coal mining plows. In such cases, the plow guide troughs are mounted on the working-face side on conveyor pans of a chain scraper conveyor for removing coal plowed off the longwall face by the mining plow. The length of the plow guide troughs is equal to the length of a conveyor pan, and the chain scraper conveyor and the plow guide may be formed by joining numerous substantially similar plow guide troughs and conveyor pans by tension-resistant bendable coupling means in the form of toggles, respectively. For example, U.S. Pat. Nos. 7,641,286 B2 and 7,188,441 B2 relate to plow guide elements of a plow guide for guiding a mining plow.

In modern heavy-duty plow systems, the mining plow may be mechanically guided on a top guide rail and a bottom guide beam, both respectively provided at each of the plurality of plow guide troughs and axially aligned to one another, respectively. The mining plow may include, for example, two bottom guide members, known as guide skids, that rest on a slideway also provided at each of the plow guide troughs. The slideway may project over the bottom guide beam. The two bottom guide members may engage the bottom guide beam by, for example, by at least partially encompassing the bottom guide beam in a U-shaped manner.

During operation of the mining plow running along the chain scraper conveyor back and forth, the top and bottom guiding members of the mining ploy may be subjected to wear. Especially the bottom guide members are highly stressed, since the bottom guide members support the whole mining plow against the ground. For replacing one of the worn bottom guide members by a new bottom guide member, it is known to disassemble one of the plow guide troughs for getting access to the worn bottom guide member. However, in case of two bottom guide members, a further plow guide trough has to be removed for replacing the other worn bottom guide member by a new bottom guide member. Such maintenance work of replacing all worn bottom guide members may be time-consuming and, thus, may lead to less efficiency of the whole mining device, since no extraction work can be performed during the maintenance work.

The present disclosure is directed, at least in part, to improving or overcoming one or more aspects of prior systems.

SUMMARY OF THE DISCLOSURE

According to an aspect of the present disclosure, a plow guide assembly of a plow guide for guiding a mining plow used in underground mining applications is disclosed. The mining plow may have at least one top guide member and at least one bottom guide member. The plow guide assembly may comprise a base member defining a bottom chain guide duct, a top chain guide duct disposed above the bottom chain guide duct, and a top guide rail configured to guide the at least one top guide member of the mining plow. The base member may include a first guide beam extending along a first axis, and being configured to guide the at least one bottom guide member of the mining plow, and a second guide beam spaced apart the first guide beam for defining a service clearance therebetween. The second guide beam may extend along a second axis axially aligned to the first axis and may be configured to guide the at least one bottom guide member. The plow guide assembly may further comprise a removable insert element configured to be inserted into the service clearance and to be attached to the base member. The insert element may have a third guide beam extending along a third axis and being configured to guide the at least one bottom guide member. In an assembled state of the insert element, the third axis may be axially aligned to the first and second axes. The plow guide assembly may further comprise a supporting device configured to support and position the insert element relative to the base member.

According to an embodiment of the present disclosure, the supporting device may include at least one protrusion provided at the base member and at least partially protruding into the service clearance, and at least one recess provided at the insert element and configured to engage the at least one protrusion.

According to another embodiment of the present disclosure, the supporting device includes at least one protrusion provided at the insert element and extending along the third axis, at least one recess provided at the first beam and configured to engage the at least one protrusion, and at least one recess provided at the second beam and configured to engage at least one protrusion.

According to another aspect of the present disclosure, a plow guide for attaching to a chain scraper conveyor including a plurality of conveyor pans connected to one another is disclosed. The plow guide may comprise a plurality of plow guide elements connected to one another, and at least one plow guide assembly according to the present disclosure. The at least one plow guide assembly may be connected to at least one of the plurality of plow guide elements.

According to another aspect of the present disclosure, a chain scraper conveyor may comprise a plurality of conveyor pans connected to one another, and a plow guide according to the present disclosure. The plow guide may be attached to the plurality of conveyor pans.

According to another aspect of the present disclosure, a method for replacing a worn bottom guide member of a mining plow is disclosed. The bottom guide member may be configured to be guided by a plow guide according to the present disclosure. The method may comprise moving the mining plow to a position, such that at least one bottom guide member is disposed at the at least one plow guide assembly, disassembling the insert element from the base member thereby providing access to at least one bottom guide member to be replaced via the service clearance, replacing the worn bottom guide member by a new bottom guide member, and assembling the insert element to the base member.

Other features and aspects of this disclosure will be apparent from the following description and the accompanying drawings.

DETAILED DESCRIPTION

Figure 1:
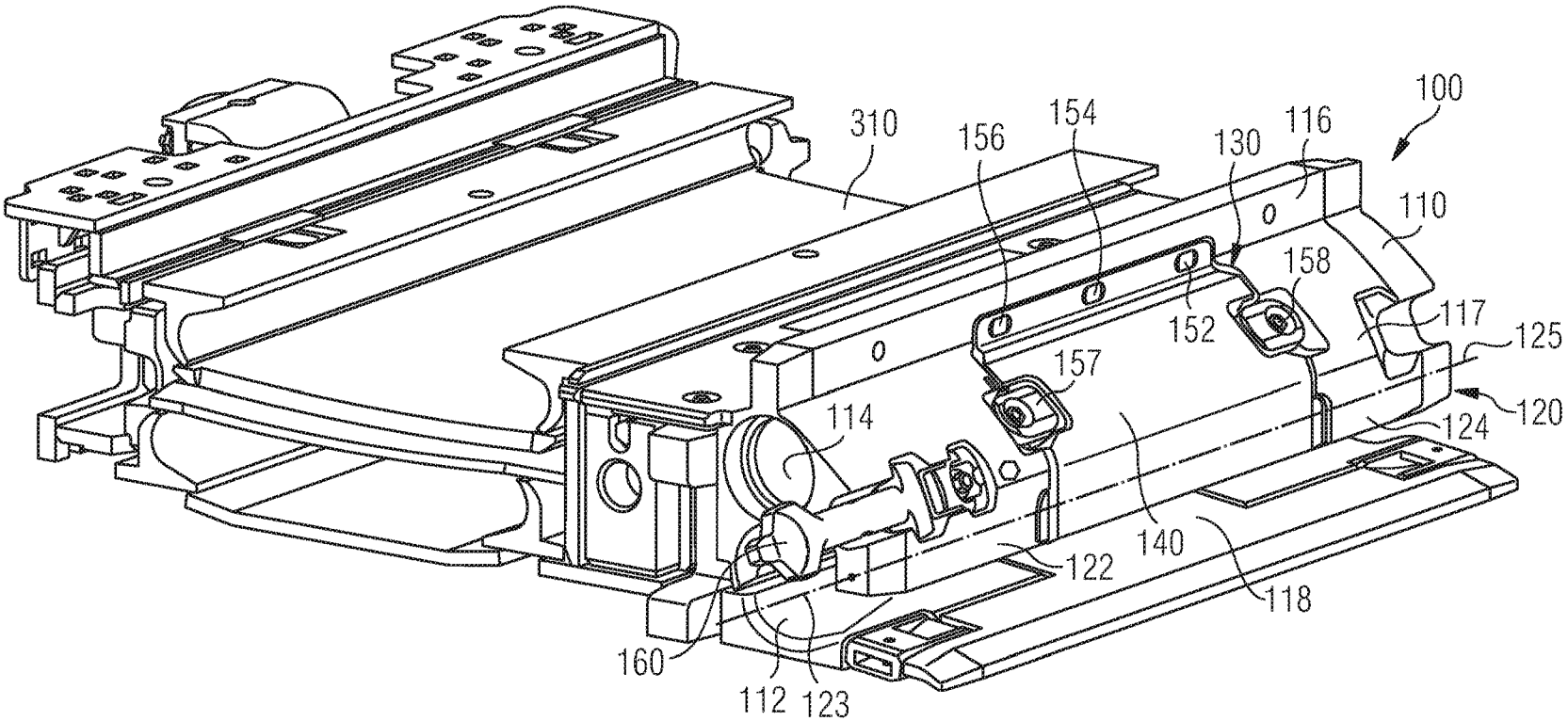
FIG. 1 is a perspective view of an exemplary disclosed plow guide assembly attached to a conveying pan of a chain scraper conveyor with an insert element assembled to a plow guide assembly base member.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure may be based at least in part on the realization that providing at least one of a plurality of plow guide elements of a plow guide with a service clearance and an insert element insertable into the service clearance may facilitate maintenance work of the bottom guide members of the mining plow, especially when replacing worn bottom guide elements with new ones.

The present disclosure may be further based at least in part on the realization that providing the insert element with a portion of a bottom guide rail of the plow guide element may further facilitate maintenance work of the bottom guide members of the mining plow. Since the bottom guide rail engages the bottom guide members of the mining plow, disassembling of the insert element equipped with a portion of the bottom guide rail may provide access to the bottom guide member to be replaced.

The present disclosure may be further based at least in part on the realization that providing at least one of a plurality of plow guide elements of a plow guide with a service clearance and an insert element may provide the possibility to replace each of the bottom guide members of the mining plow via one service clearance. Therefore, only one of the plurality of plow guide elements connected to one another for forming a plow guide for a mining plow may need to be provided with an insert element and a service clearance.

Figure 9:
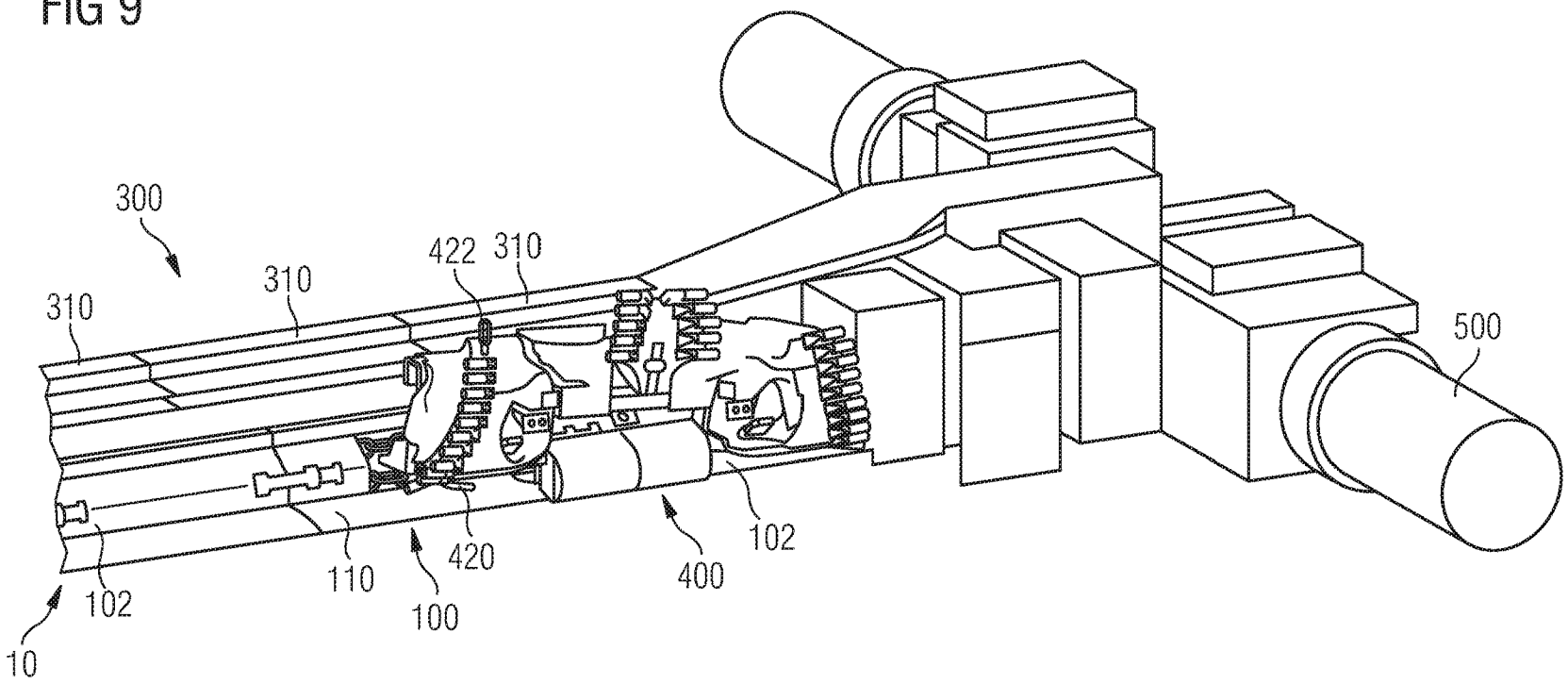
FIG. 9 is a perspective view of a chain scraper conveyor with a mining plow mounted to a plow guide shown in a position for replacing a first worn bottom guide member of the mining plow.
Figure 10:
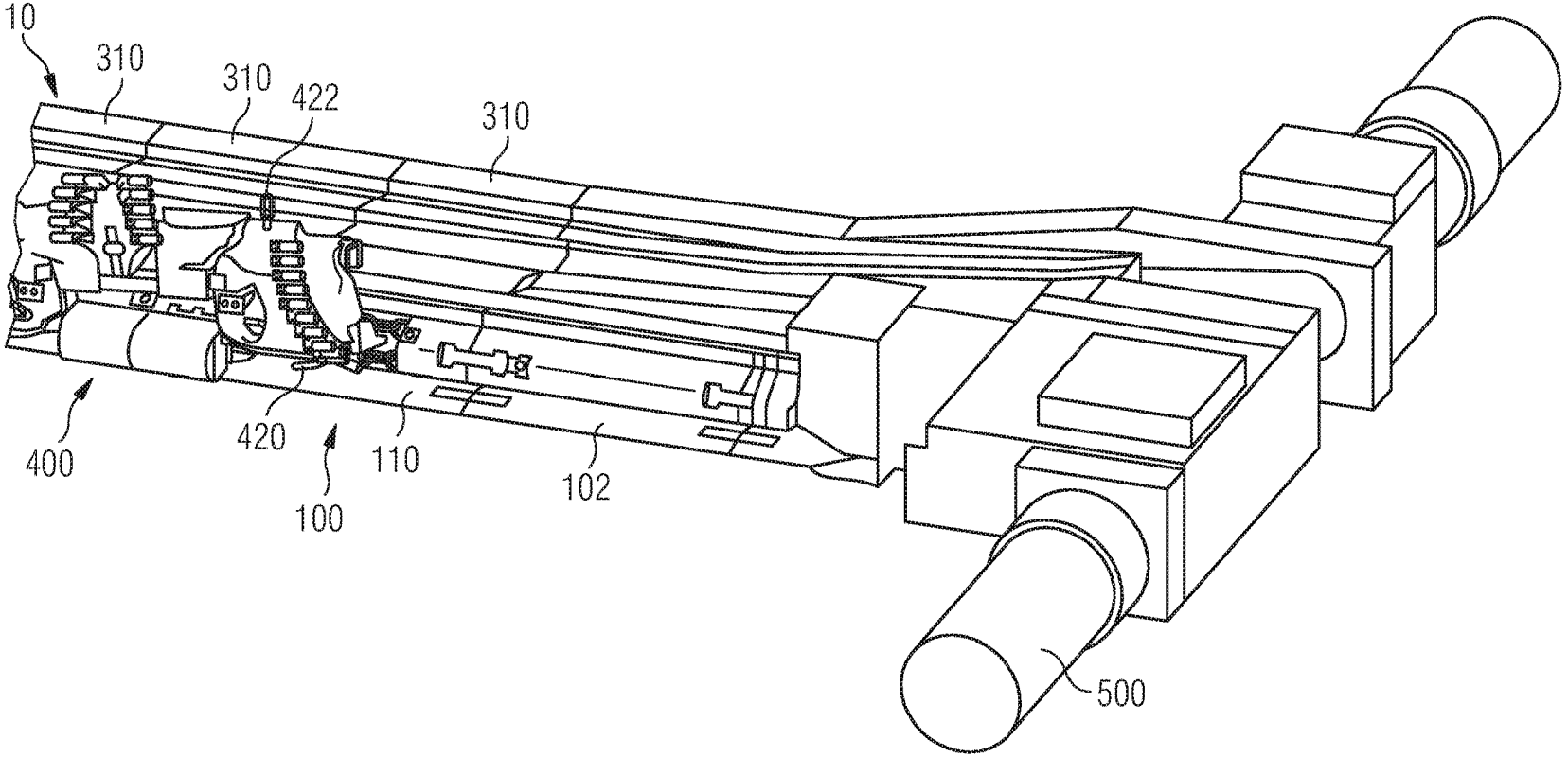
FIG. 10 is a perspective view of the chain scraper conveyor of FIG. 9 with the mining plow shown in a position for replacing a second worn bottom guide member of the mining plow.

FIG. 1 is a perspective view of a plow guide assembly 100 of a plow guide 10 for a mining plow 400 (see FIGS. 9 and 10). The plow guide assembly 100 is mounted in known manner to a conveyor pan 310 of a chain scraper conveyor 300 (see FIGS. 9 and 10) on the working-face side. A line of the chain scraper conveyor 300 is formed of individual conveyor pans 310 connected to one another in tension-resistant manner with limited ability to bend. Similarly, the plow guide 10 is formed of individual plow guide elements 102 connected to one another in tension-resistant manner with limited ability to bend, and at least one plow guide assembly 100 connected to the plow guide elements 102. In the exemplary embodiment shown in the drawings, the plow guide elements form a side cheek of associated conveyor pans 310 of the chain scraper conveyor 300 on the working-face side and are substantially equal in length to the conveyor pans 310 of the chain scraper conveyor 300. The basic construction of conveyor pans 310 of this type is known and therefore not discussed here in detail.

As shown in FIG. 1, an exemplary plow guide assembly 100 has a base member 110 including a bottom chain guide duct 112, a top chain guide duct 114 disposed above the bottom chain guide duct 112, and a top guide rail 116 extending along the length of the base member 110. The base member 110 further includes a front wall 117 facing the coal face or working face, and a slideway 118 extending towards the coal face and resting on the ground. The base member 110 is a cast one-piece base member provided during the initial forming process with the bottom chain guide duct 112, the top chain guide duct 114, the top guide rail 116, and the slideway 118.

The base member 110 further includes a first guide beam 122 and a second guide beam 124 spaced apart the first guide beam 122 thereby defining a service clearance 130. The first and second guide beams 122, 124 are integrally formed with the base member 110. In some further embodiments, the first and second guide beams 122, 124 may be attached to the base member 110 via any known fastening device, such as, for example, welding.

The exemplary disclosed plow guide assembly 100 further includes a removable insert element 140 that is insertable into the service clearance 130 and attachable to the base member 110 via a fastening device, such as, for example, a plurality of screws 152, 154, 156, 157, 158. In FIG. 1, the insert element 140 is shown in an assembled position. In the assembled position of the insert element 140, each of the screw heads of the plurality of screws 152, 154, 156, 157, 158 may be recessed in an associated cavity, such that the screw heads may not disturb proper operation of the mining plow 400.

A connecting member 160 is configured to connect the plow guide assembly 100 to an adjacent plow guide element 102. On the other side, a further connecting member (not shown) may also be provided for connecting the plow guide assembly 100 to an adjacent plow guide element 102. The plow guide 10 according to the present disclosure may include only one plow guide assembly 100 for performing maintenance work at the mining plow 400.

Figure 2:
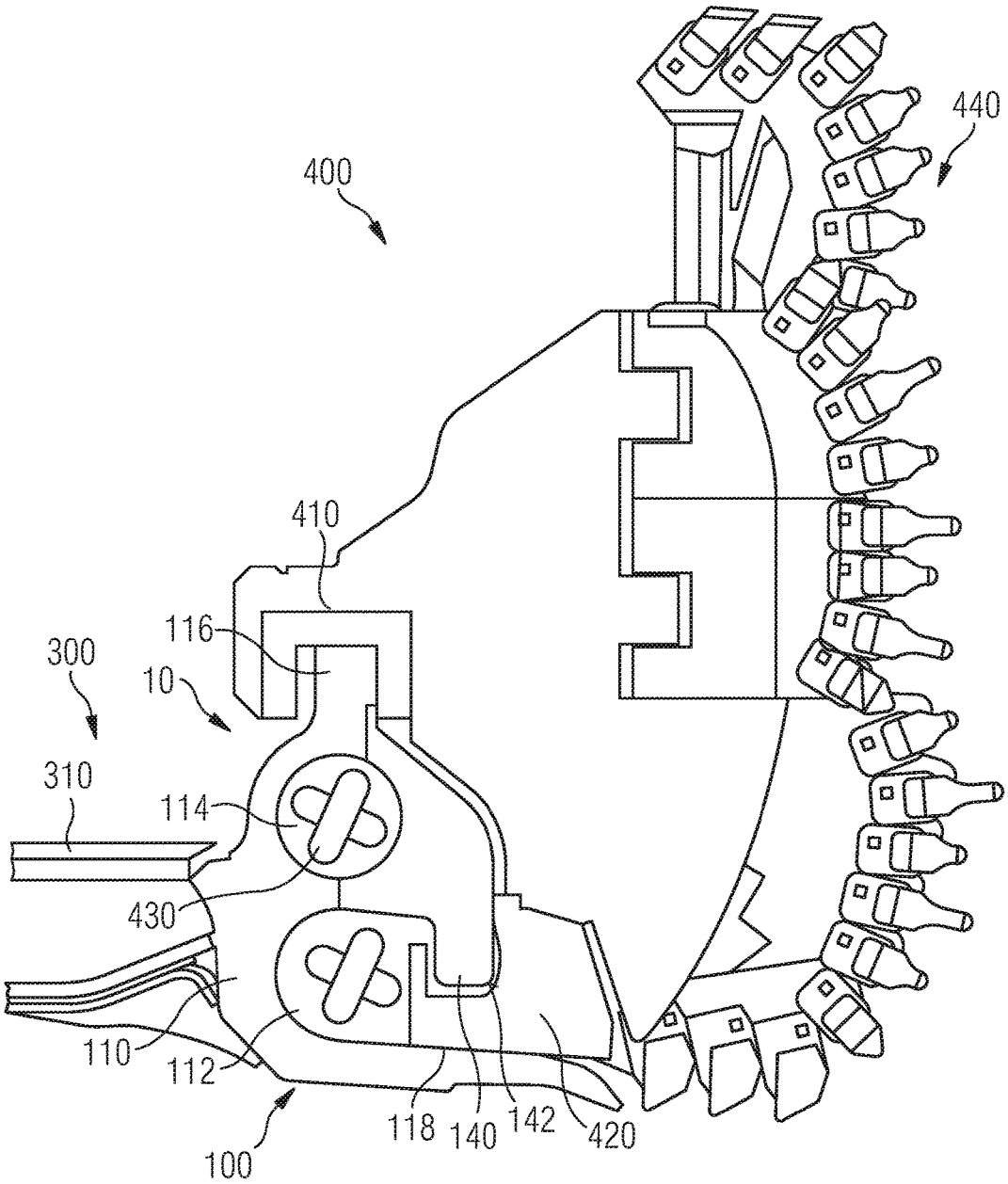
FIG. 2 is a cross-sectional view of a mining plow movably mounted to the plough guide assembly of FIG. 1.

Referring to FIG. 2, a cross-sectional view through a chain scraper conveyor 300 with an attached plow guide 10 guiding a mining plow 400 is shown. The mining plow 400 is of a known type and includes at least one top guide member 410 engaging the top guide rail 116, and at least one bottom guide member 420 sliding over the slideway 118 and engaging the first and second guide beams 122, 124. The first and second guide beams 122, 124 are part of a bottom guide rail 120 extending along the plow guide 10. As indicated in FIG. 2, the insert element 140 includes a third guide beam 142 also forming part of the bottom guide rail 120, which will be described in greater detail with reference to FIG. 3.

As can be seen in FIG. 2, the mining plow 400 is guided by the plow guide 10 by engaging the top guide rail 116 and the bottom guide rail 120. Particularly, both the top guide member 410 and the bottom guide member(s) 420 at least partially encompass the top guide rail 116 and the bottom guide rail 120, respectively, thereby axially securing the mining plow 400 in a left-right direction and up-down direction in FIG. 2.

As also indicated in FIG. 2, the mining plow 400 is attached to an endless chain 430 extending through the top and bottom chain guide ducts 112, 114 and driven by a drive unit 500 (see FIGS. 9 and 10). The mining plow 400 further includes a plurality of cutting bits 440 replaceably mounted to the mining plow 400 and configured to engage and extract coal material.

Figure 3:
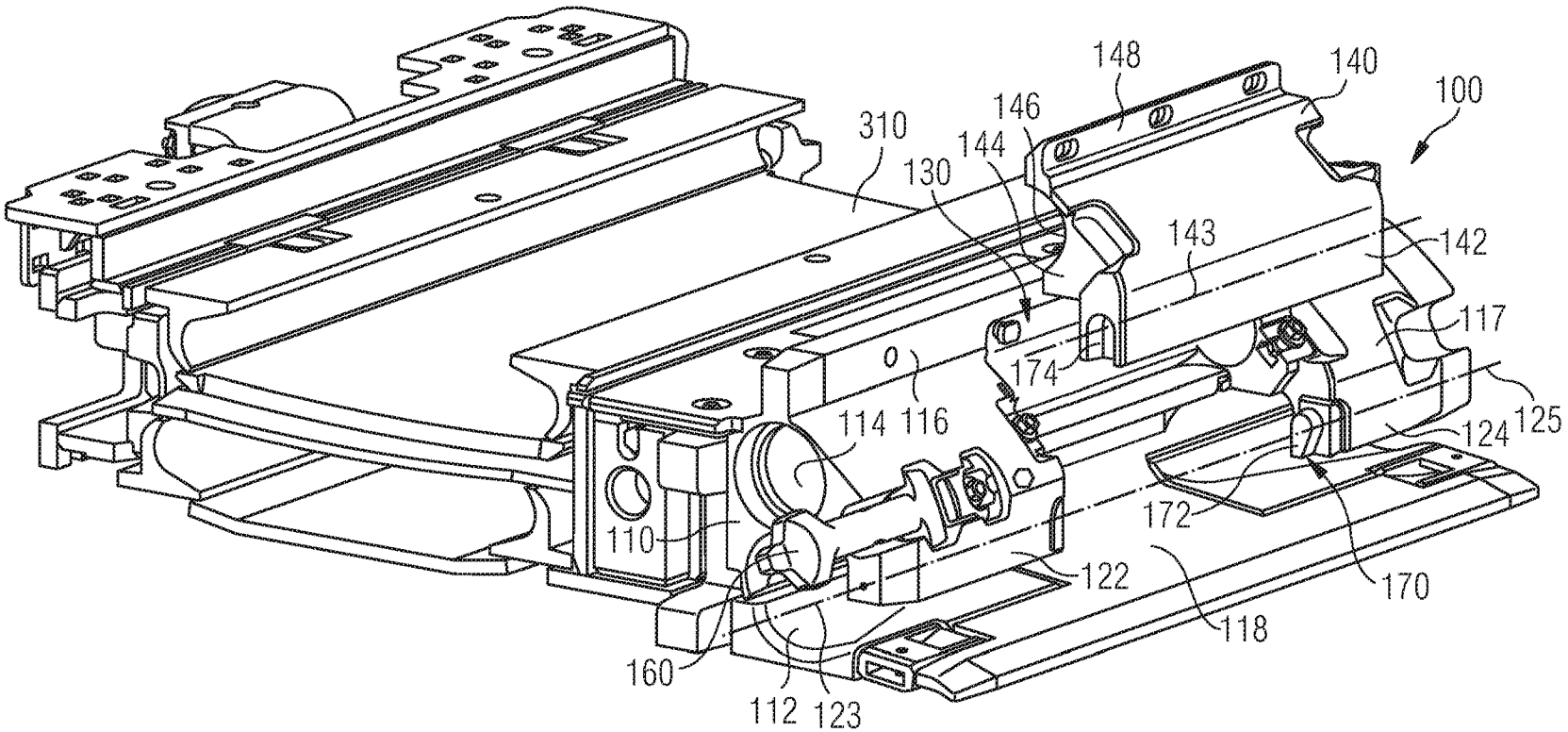
FIG. 3 is a perspective view of the plow guide assembly of FIG. 1 with the insert element disassembled from the base member and illustrating a first embodiment of a supporting device for supporting the insert element at the base member.

Referring to FIG. 3, the plow guide assembly 100 of FIG. 1 is shown in an exploded view, with the insert element 140 disassembled from the base member 110. As shown, the first guide beam 122 extends along a first axis 123 and the second guide beam 124 extends along a second axis 125 axially aligned with the first axis 123. The first and second guide beams 122, 124 are substantially identical in shape.

The insert element 140 includes a third guide beam 142 extending along a third axis 143. When being in the assembled position (as shown in FIG. 1), the third axis 143 is axially aligned with the first and second axes 123, 125. Further, the third guide beam 142 is substantially identical in shape to the first and second guide beams 122, 124. Hence, when being in the assembled position, the bottom guide rail 120 of the exemplary disclosed plow guide assembly 100 is formed by the first, second, and third guide beams 122, 124, 142 respectively.

As indicated in FIG. 3, the insert element 140 may further include a bottom chain guide duct forming section 144 forming at least a portion of the bottom chain guide duct 112 and/or a top chain guide duct forming section 146 forming at least a portion of the top chain guide duct 114. In such case, the service clearance 130 may be enlarged and, hence, replacement of worn bottom guide members 420 may be further facilitated.

As can be further seen in FIG. 3, the insert element 140 may further inlcude a top guide rail forming section 148 forming at least a portion of the top guide rail 116. As shown, the top guide rail forming section 148 extends vertically and is at least partially recessed in the top guide rail 116. The top guide rail forming section 148 is configured to at least partially guide the mining plow 400 along the top guide rail 116 of the plow guide assembly 100.

Figure 4:
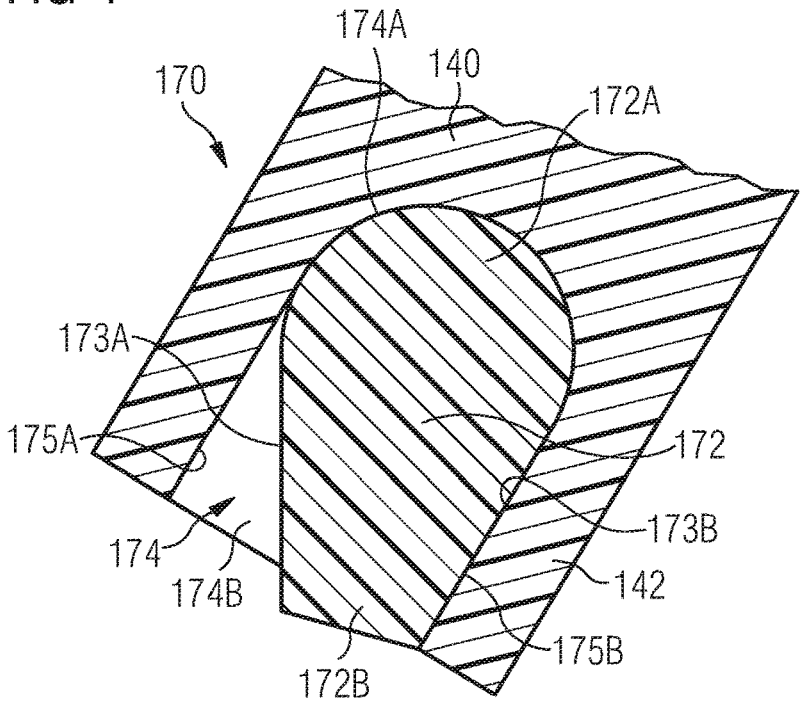
FIG. 4 is a cross-sectional view of the first embodiment of the supporting device of the plow guide assembly of FIG. 3 in an unlocked position of the insert element.
Figure 5:
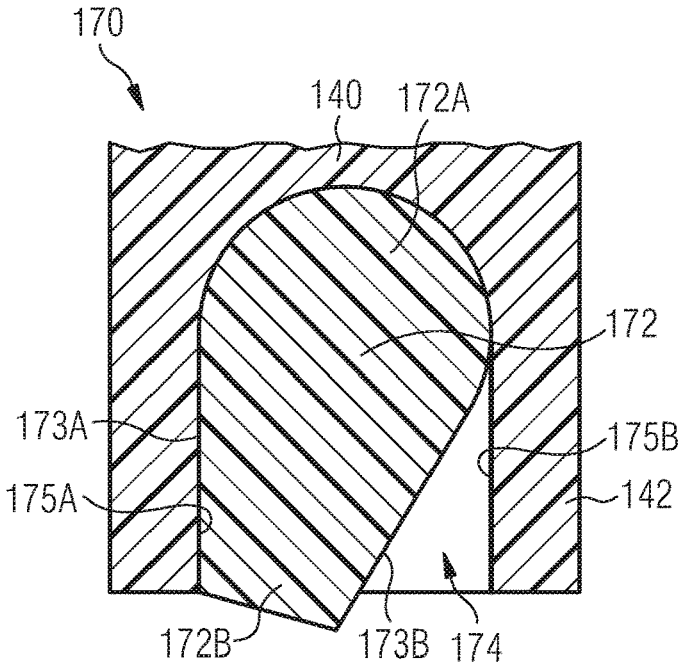
FIG. 5 is a cross-sectional view of the supporting device of the plow guide assembly of FIG. 3 in the locked position of the insert element.

A first embodiment of a supporting device 170 for supporting and positioning the insert element 140 relative to the base member 110 is illustrated in FIGS. 3 to 5. It can be seen that the supporting device 170 of the embodiment shown in FIGS. 3 to 5 includes two protrusions 172 (only one of which is visible in FIG. 3) provided at the base member 110 and at least partially protruding into the service clearance 130. Specifically, as shown in FIG. 3, the protrusions 172 protrude into the service clearance 130 in extension of the first and second guide beams 122, 124 along the first and second axes 123, 125.

The supporting device 170 further includes two recesses 174 (only one of which is visible in FIG. 3) provided at the insert element 140. The recesses 174 open downwards and, hence, can be slipped over the protrusions 172. For example, the recesses 174 are provided at face sides of the third beam 142 and are recessed along the third axis 143.

FIGS. 4 and 5 depict cross-sectional views of the first embodiment of the supporting device 170 through a protrusion 172 received in an associated recess 174. Particularly, FIG. 4 illustrates the insert element 140 in an unlocked position, wherein FIG. 5 illustrates the insert element 140 in a locked position.

As shown in FIGS. 4 and 5, each of the protrusions 172 has a cross-sectional shape including an upper semicircular section 172A and a lower tapered section 172B having an inner face 173A facing towards the bottom chain guide duct 112 (see FIG. 2) and an outer face 173B facing towards the coal face. Particularly, in the embodiment shown in FIGS. 3 to 5, the protrusions 172 are provided at the base member 110, such that the inner faces 173A substantially extend vertically.

The recesses 174 each have a cross-sectional shape including an upper semicircular section 174A and a lower rectangular section 174B having an inner face 175A facing towards the bottom chain guide duct 112 (see FIG. 2) and an outer face 175B facing towards the coal face. A diameter of the semicircular section 174A of the recess 174 is equal or greater than a diameter of the semicircular section 172A of the protrusion 172.

The process of inserting the insert element 140 into the service clearance 130 of the base member 110 is now described with reference to FIGS. 3 to 5. At first, the insert element 140 is obliquely inserted into the service clearance 130, such that each protrusion 172 is put over an associated recess 174. Then, the outer faces 175B of the recesses 174 contact and abut the outer faces 173B of the protrusions 172, which is shown in FIG. 4.

Then, the insert element 140 is pivoted in a counter-clockwise direction in FIG. 3, such that the inner faces 175A of the recesses 174 contact and abut the inner faces 173A of the protrusions 172 (see FIG. 5). In such position, the first, second, and third axes 123, 125, 143 are axially aligned to one another and a uniform guiding surface for guiding the bottom guide members 420 of the mining plow 400 is formed. Particularly, after pivoting the insert element 140 from the unlocked position of FIG. 4 into the locked position of FIG. 5, the insert element 140 is positioned relative to the base member 110 as shown in FIG. 1 and the insert element 140 can be fixed to the base member 110 via the fixing device. During pivoting of the insert element 140, the third guide beam 142 engages the bottom guide member 420.

Due to the specific shape of the protrusions 172 shown in FIGS. 3 to 5, any dirt may not accumulate at the protrusions and, hence, may not disturb assembling the insert element 140 to the base member 110.

In another embodiment, the protrusions 172 may have a cross-sectional shape including an upper semicircular section and a lower rectangular section. In such embodiments, the recesses 174 may have a cross sectional shape including an upper semicircular section and a lower conical section.

Figure 6:
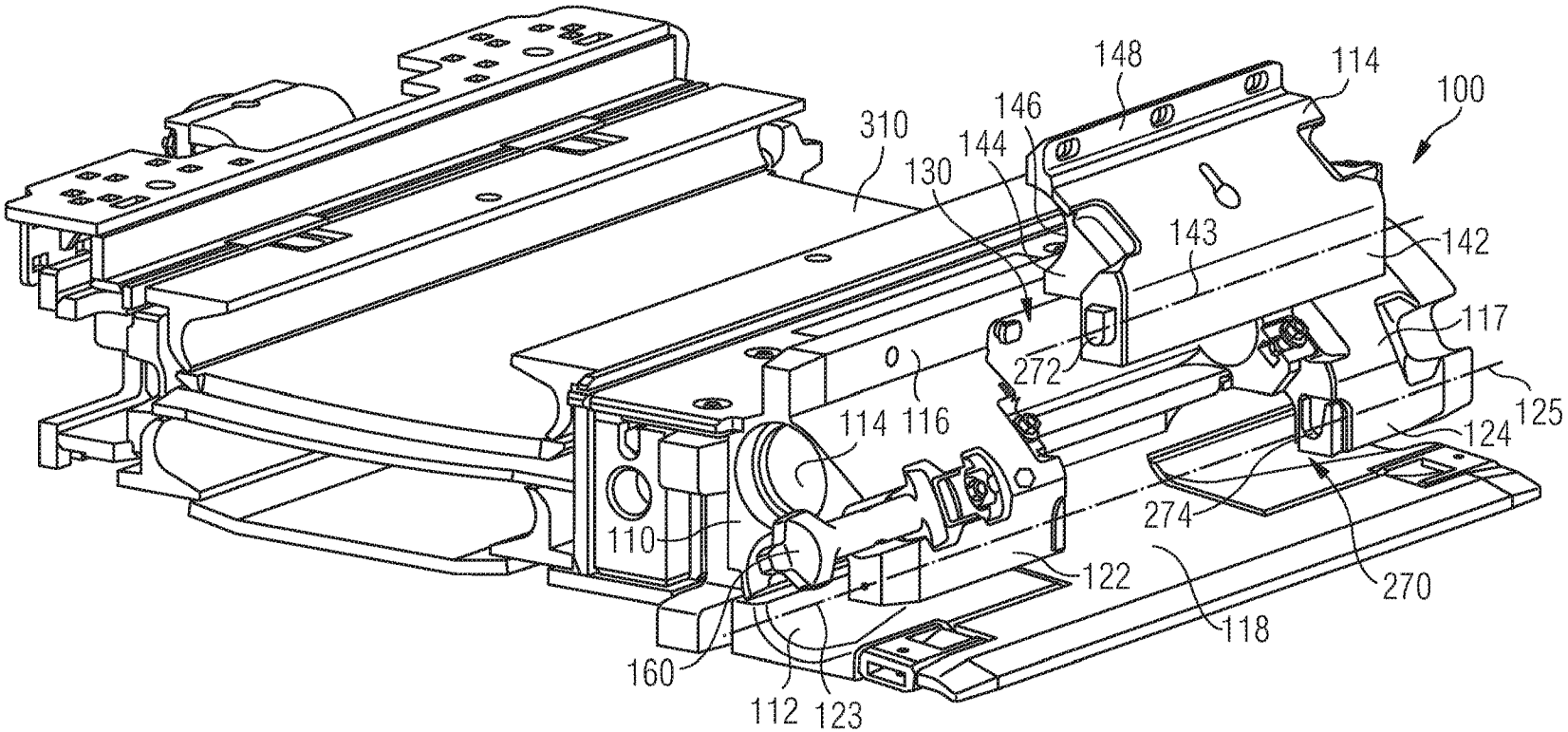
FIG. 6 is a perspective view of the plow guide assembly of FIG. 1, with the insert element disassembled from the base member and illustrating a second embodiment of the supporting device for supporting the insert element at the base member.
Figure 7:
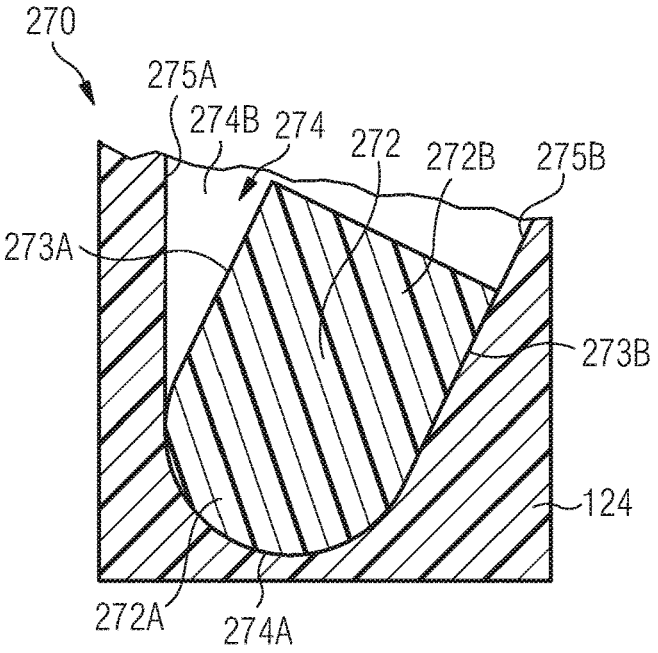
FIG. 7 is a cross-sectional view of the supporting device of the plow guide assembly of FIG. 6 in an unlocked position of the insert element.
Figure 8:
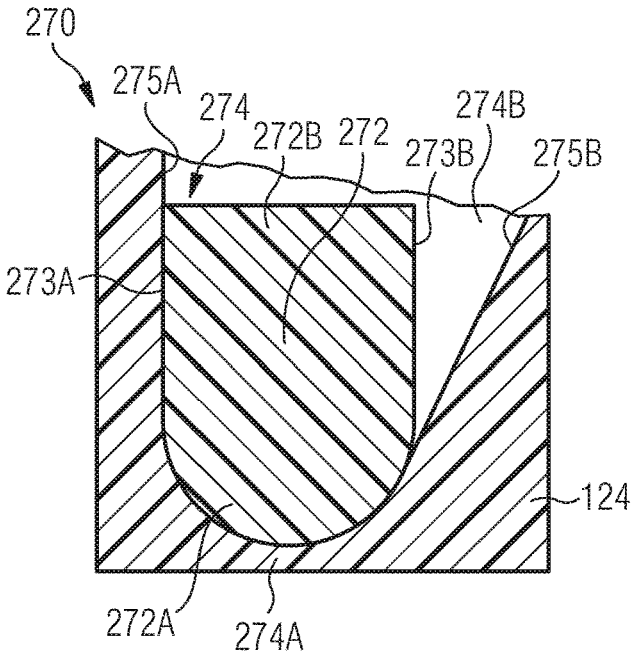
FIG. 8 is a cross-sectional view of the supporting device of the plow guide assembly of FIG. 6 in the locked position of the insert element.

Referring to FIGS. 6 to 8, another exemplary embodiment of a supporting device 270 for supporting the insert element 140 at the base member 110 is illustrated. The plow guide assembly 100 of FIG. 6 is substantially identical with the plow guide assembly 100 of FIG. 3, but differs in the configuration of the supporting devices 170, 270. Hence, same components of FIGS. 3 and 6 bear same reference signs and repetition of the description of such components is omitted here.

With respect to FIG. 6, it can be seen that the supporting device 270 of the embodiment shown in FIGS. 6 to 8 includes two protrusions 272 (only one of which is visible in FIG. 6) provided at the insert element 140. Specifically, as shown in FIG. 6, the protrusions 272 protrude from face sides of the insert element 140 in extension of the third guide beam 142 along the third axis 143.

The supporting device 270 further includes two recesses 274 (only one of which is visible in FIG. 6) provided at the base member 110. The recesses 274 open upwards for receiving and supporting the protrusions 272. The recesses 274 are provided at inner face sides of the first and second beams 122, 124 and are recessed along the first and second axes 123, 125, respectively.

FIGS. 7 and 8 depict cross-sectional views of the supporting device 270 through a protrusion 272 received in an associated recess 274 provided at the second guide beam 124. Particularly, FIG. 7 illustrates the insert element 140 in an unlocked position, wherein FIG. 8 illustrates the insert element 140 in a locked position.

As shown, each of the protrusions 272 has a cross-sectional shape including a lower semicircular section 272A and an upper rectangular section 272B having an inner face 273A facing towards the bottom chain guide duct 112 (see FIG. 2) and an outer face 273B facing towards the coal face.

The recesses 274 each have a cross-sectional shape including a lower semicircular section 274A and an upper conical section 274B having an inner face 275A facing towards the bottom chain guide duct 112 (see FIG. 2) and an outer face 275B facing towards the coal face. Particularly, in the embodiment shown in FIGS. 6 to 8, the recesses 274 are provided at the base member 110, such that the inner faces 274A substantially extend vertically. Further, the diameter of the semicircular section 274A of the recess 274 is equal or greater than the diameter of the semicircular section 272A of the protrusion 272. Further, The process of inserting the insert element 140 into the service clearance 130 of the base member 110 is now described with reference to FIGS. 6 to 8. At first, the insert element 140 is obliquely inserted into the service clearance 130, such that the recesses 274 receive the protrusions 272. Specifically, the outer faces 275B of the recesses 274 contact and abut the outer faces 273B of the protrusions 272, which is shown in FIG. 7.

Then, the insert element 140 is pivoted in a counter-clockwise direction in FIG. 3, such that the inner faces 275A of the recesses 274 contact and abut the inner faces 273A of the protrusions 272 (see FIG. 8). In such position, the first, second, and third axes 123, 125, 143 are axially aligned to one another and a uniform guiding surface for guiding the bottom guide members 420 of the mining plow 400 is formed. Particularly, after pivoting the insert element 140 from the unlocked position of FIG. 7 into the locked position of FIG. 8, the insert element 140 is positioned relative to the base member 110 as shown in FIG. 1 and the insert element 140 can be fixed to the base member 110 via the fixing device 190.

In another embodiment, the protrusions 272 may have a cross-sectional shape including a lower semicircular section and an upper tapered section. In such embodiments, the recesses 274 may have a cross sectional shape including a lower semicircular section and an upper rectangular section.

In another embodiment, instead of providing the recesses 274 asymmetrically at the face sides of the first and second guide beams 122, 124, respectively, and the protrusions 272 symmetrically at the faces sides of the third beam 142, it may also be possible to provide the protrusions asymmetrically at the face sides of the third beam 142 and the recesses 274 symmetrically at the face sides of the first and second guide beams 122, 124, respectively.

It should be noted that, after having pivoted the insert element 140 from the unlocked into the locked position and having fixed the insert element 140 to the base member 110, the first, second, and third axes 123, 125, 143 should be aligned to one another, such that the first, second, and third beams 122, 124, 142 together form the bottom guide rail 120 for guiding the bottom guide members 420 of the mining plow 400.

INDUSTRIAL APPLICABILITY

In the following, an exemplary method for replacing worn bottom guide members 420 of the mining plow 400 will be described with reference to the drawings, especially with respect to FIGS. 9 and 10. When detecting worn bottom guide members 420, the mining plow 400 may be moved to the plow guide assembly 100, as shown in FIG. 9.

In the assembled state, the third guide beam 142 of the insert element 140 engages the left bottom guide member 420 (see, for instance, FIG. 2), However, disassembling the insert element 140 from the base member 110 provides access to, for instance, the left bottom guide member 420 (see FIG. 9). As the insert element 140 of FIGS. 3 and 6 may include the above-mentioned bottom chain guide duct forming section 144 and a top chain guide duct forming section 146, the service clearance 130 may be enlarged for having better access to the worn left bottom guide element 420.

After having disassembled the insert element 140, the left end of the mining plow 400 is at least partially lifted by a lifting device, such as, for instance, a crane apparatus engaging a towing eye 422 attached to the mining plow 400. In such state, the left bottom guide member 420 is accessible and removable from the base member 110.

After having replaced the worn bottom guide member 420 by a new one and lowered the mining plow 400 onto the slideway 118, the insert element 140 is assembled to the base member 110, as described above with respect to FIGS. 3 to 5 and FIGS. 6 to 8, respectively.

In case that the other bottom guide member 420 is also worn, the mining plow 400 is moved to the plow guide assembly 100, as shown in FIG. 10. In such case, after having already replaced the other bottom guide member 420 as described above, the insert element 140 may maintain disassembled while the mining plow 400 is moved into the position as shown in FIG. 10. Then, the above-mentioned method for replacing the worn bottom guide member 420 may be performed with respect to the right bottom guide member 420.

It should be noted that the length of the insert element 140 in the direction of the third axis 143 is equal or greater than the length of the greatest bottom guide member 420 of the mining plow 400, such that each bottom guide member 420 may be replaced via one plow guide assembly 100 having an insert element and a service clearance 130 as disclosed herein.

In another aspect of the present disclosure, an insert element for inserting into a service clearance provided at a base member of a plow guide element for guiding a mining plow is disclosed. The base member may define a bottom chain guide duct, a top chain guide duct disposed above the bottom chain guide duct, and a top guide rail configured to guide at least one top guide member of the mining plow. The base member may include a first guide beam extending along a first axis, and being configured to guide the at least one bottom guide membe of the mining plow, and a second guide beam spaced apart the first guide beam for defining a service clearance therebetween. The second guide beam may extend along a second axis axially aligned to the first axis and may be configured to guide the at least one bottom guide member of the mining plow. The insert element according of the present disclosure may include a third guide beam extending along a third axis and being configured to guide the at least one bottom guide member. In an assembled state of the insert element, the third axis may be axially aligned to the first and second axes.

Although the preferred embodiments of this invention have been described herein, improvements and modifications may be incorporated without departing from the scope of the following claims.

The invention claimed is:

1. A plow guide assembly of a plow guide for guiding a mining plow used in underground mining applications, the mining plow having at least one top guide member and at least one bottom guide member, the plow guide assembly comprising:

a base member defining a bottom chain guide duct and a top chain guide duct disposed above the bottom chain guide duct, the base member including:

a top guide rail extending along an entire length of the base member, and having a substantially solid, rectangular cross-section configured to guide the at least one top guide member of the mining plow;

a first guide beam extending along a first axis, and being configured to guide the at least one bottom guide member of the mining plow; and a second guide beam spaced apart from the first guide beam for defining a service clearance therebetween, the second guide beam extending along a second axis axially aligned to the first axis and being configured to guide the at least one bottom guide member;

a removable insert element configured to be inserted into the service clearance and to be attached to the base member, the insert element having a third guide beam extending along a third axis and being configured to guide the at least one bottom guide member, wherein, in an assembled state of the insert element, the third axis is axially aligned to the first and second axes to form a bottom guide rail extending along an entire length of the plow guide and configured to guide the at least one bottom guide member; and a supporting device configured to support and position the insert element relative to the base member.

2. The plow guide assembly of claim 1, wherein the insert element further includes a bottom chain guide duct forming section forming at least a portion of the bottom chain guide duct and a top chain guide duct forming section forming at least a portion of the top chain guide duct.

3. The plow guide assembly of claim 1, wherein the insert element further includes a top guide rail forming section forming at least a portion of the top guide rail.

4. The plow guide assembly of claim 1, wherein a length of the insert element along the third axis is configured to be equal or greater than a length of the at least one bottom guide member of the mining plow along the third axis.

5. A plow guide for attaching to a chain scraper conveyor including a plurality of conveyor pans connected to one another, the plow guide comprising:

a plurality of plow guide elements connected to one another; and at least one plow guide assembly according to claim 1, the at least one plow guide assembly being connected to at least one of the plurality of plow guide elements.

6. A chain scraper conveyor comprising:

a plurality of conveyor pans connected to one another; and a plow guide according to claim 5, the plow guide being attached to the plurality of conveyor pans.

7. A method for replacing a worn bottom guide member of the mining plow, the at least one bottom guide member being configured to be guided by the plow guide according to claim 5, the method comprising:

moving the mining plow to a position, such that the at least one bottom guide member is disposed at the at least one plow guide assembly;

disassembling the insert element from the base member thereby providing access to the at least, one bottom guide member via the service clearance;

replacing the worn bottom guide member by a new bottom guide member; and assembling the insert element to the base member.

8. The method of claim 7, further comprising at least partially lifting the mining plow prior to replacing the worn bottom guide member by a new bottom guide member.

9. The method of claim 7, wherein the mining plow includes two bottom guide members and each of the bottom guide members of the mining plow is replaceable via the at least one plow guide assembly.

10. A plow guide assembly of a plow guide for guiding a mining plow used in underground mining applications, the mining plow having at least one top guide member and at least one bottom guide member, the plow guide assembly comprising:

a base member defining a bottom chain guide duct and a top chain guide duct disposed above the bottom chain guide duct, the base member including:

a top guide rail extending along an entire length of the base member, and having a substantially solid, rectangular cross-section configured to guide the at least one top guide member of the mining plow;

a first guide beam extending along a first axis, and being configured to guide the at least one bottom guide member of the mining plow; and a second guide beam spaced apart from the first guide beam for defining a service clearance therebetween, the second guide beam extending along a second axis axially aligned to the first axis and being configured to guide the at least one bottom guide member;

a removable insert element configured to be inserted into the service clearance and to be attached to the base member, the insert element having a third guide beam extending along a third axis and being configured to guide the at least one bottom guide member, wherein, in an assembled state of the insert element, the third axis is axially aligned to the first and second axes to form a bottom guide rail extending along a length of the plow guide and configured to guide the at least one bottom guide member; and a supporting device configured to support and position the insert element relative to the base member, wherein the supporting device includes at least one protrusion provided at the base member and at least partially protruding into the service clearance, and at least one recess provided at the insert element and configured to engage the at least one protrusion.

11. The plow guide assembly of claim 10, wherein the at least one protrusion is provided at the first guide beam and extends along the first axis, and the at least one recess is provided at the third guide beam.

12. The plow guide assembly of claim 10, wherein, when the at least one protrusion engages the at least one recess, the insert element is at least partially pivotable relative to the base member.

13. The plow guide assembly of claim 10, wherein the at least one protrusion has a cross-sectional shape including a first semicircular section and a tapered section, and the at least one recess has a cross-sectional shape including a second semicircular section and a rectangular section, a diameter of the second semicircular section being equal to or greater than a diameter of the first semicircular section.

14. The plow guide assembly of claim 10, wherein the at least one protrusion has a cross-sectional shape including a first semicircular section and a rectangular section, and the at least one recess has a cross-sectional shape including a second semicircular section and a conical section, a diameter of the second semicircular section being equal to or greater than a diameter of the first semicircular section.

15. A plow guide assembly of a plow guide for guiding a mining plow used in underground mining applications, the mining plow having at least one top guide member and at least one bottom guide member, the plow guide assembly comprising:

a base member defining a bottom chain guide duct and a top chain guide duct disposed above the bottom chain guide duct, the base member including:

a top guide rail extending along an entire length of the base member, and having a substantially solid, rectangular cross-section configured to guide the at least one top guide member of the mining plow;

a first guide beam extending along a first axis, and being configured to guide the at least one bottom guide member of the mining plow; and a second guide beam spaced apart from the first guide beam for defining a service clearance therebetween, the second guide beam extending along a second axis axially aligned to the first axis and being configured to guide the at least one bottom guide member;

a removable insert element configured to be inserted into the service clearance and to be attached to the base member, the insert element having a third guide beam extending along a third axis and being configured to guide the at least one bottom guide member, wherein, in an assembled state of the insert element, the third axis is axially aligned to the first and second axes to form a bottom guide rail extending along a length of the plow guide and configured to guide the at least one bottom guide member; and a supporting device configured to support and position the insert element relative to the base member, wherein the supporting device includes at least one protrusion provided at the insert element and extending along the third axis, at least one recess provided at the first beam and configured to engage at least one protrusion, and at least one recess provided at the second beam and configured to engage at least one protrusion.

* * * * *